United States Patent [19]

Burns, Jr. et al.

[11] 4,290,766

[45] Sep. 22, 1981

[54] CHEMICALLY SCULPTURING ACRYLIC FABRICS AND PROCESS FOR PREPARING SAME

[75] Inventors: Alonzo M. Burns, Jr., Inman; Jeffrey E. Silliman, Spartanburg; Woodrow P. Gilbert, Spartanburg; William M. Pascoe, Sr., Spartanburg, all of S.C.

[73] Assignee: Milliken Research Corporation, Spartanburg, S.C.

[21] Appl. No.: 189,460

[22] Filed: Sep. 22, 1980

[51] Int. Cl.[3] ..... D06Q 1/02; D06P 5/00; D06M 3/16

[52] U.S. Cl. ..... 8/491; 8/492; 8/115; 8/130.1; 428/89; 428/92; 427/275

[58] Field of Search ..... 8/130.1, 115, 491, 492; 428/89, 92

[56] References Cited

U.S. PATENT DOCUMENTS

| | | | |
|---|---|---|---|
| 3,069,218 | 12/1962 | Hermes | 8/491 |
| 3,069,222 | 12/1962 | Hermes | 8/130.1 |
| 3,167,448 | 1/1965 | Hirshfeld | 8/130.1 |
| 3,797,996 | 3/1974 | Gregorian et al. | 8/114.5 |
| 3,830,683 | 8/1974 | Bohrn | 428/92 |
| 3,953,164 | 4/1976 | Boba et al. | 8/130.1 |
| 3,989,448 | 11/1976 | Bohrn | 8/115 |

*Primary Examiner*—Joseph L. Schofer
*Assistant Examiner*—Maria Parrish Tungol
*Attorney, Agent, or Firm*—H. William Petry; Terry T. Moyer

[57] ABSTRACT

A method for sculpturing a pile fabric, e.g., acrylic pile fabric, is provided which comprises contacting selected areas to be sculptured of the pile surface of the fabric with a sufficient amount of a sculpturing composition to provide a sculptured effect, said composition comprising: at least one lower alkylene carbonate, e.g., ethylene carbonate, propylene carbonate, etc., provided in said composition in a concentration sufficient so that said fibers may be subsequently caused to shrink to a lower energy configuration upon application of heat; said sculpturing composition further containing E-caprolactam in an amount sufficient to maintain a relatively soft hand of the shrunken pile fibers; and heating said pile fabric to a temperature sufficient to cause the pile height of said fibers in the selected areas of the pile fabric to be reduced sufficiently to provide a sculptured effect on said pile fabric.

15 Claims, 1 Drawing Figure

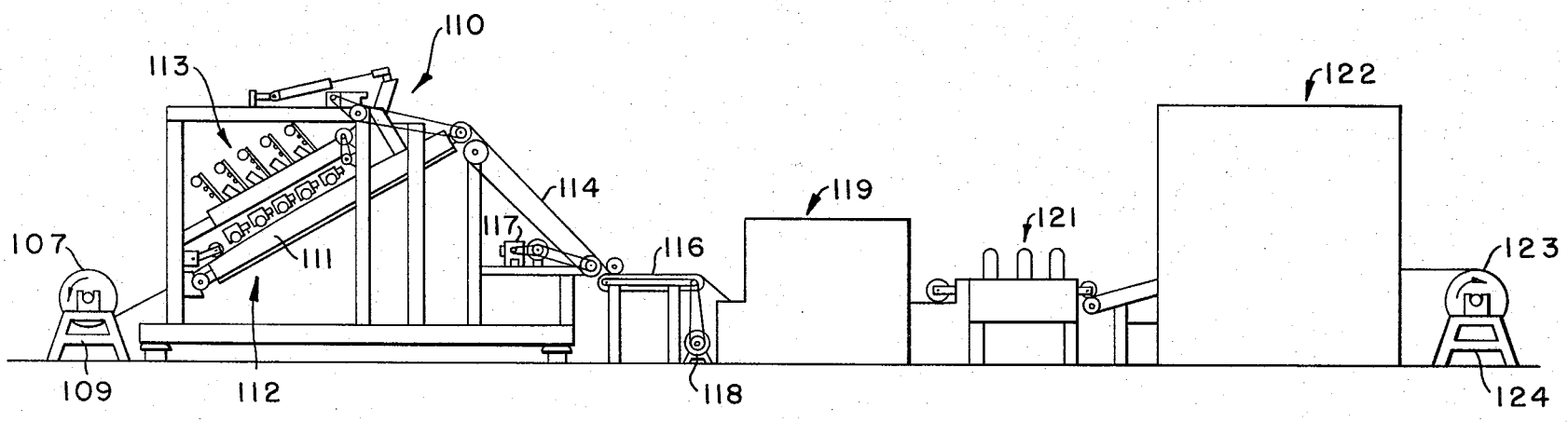
107
109
113
112
111
110
117
114
116
118
119
121
122
123
124

CHEMICALLY SCULPTURING ACRYLIC FABRICS AND PROCESS FOR PREPARING SAME

The present invention relates to a sculptured pile fabric and to a method for producing such fabrics. More particularly, the present invention relates to a chemical sculpturing method for acrylic fiber containing fabrics wherein a soft hand of the pile fibers in the sculptured areas may be maintained and fiber-to-fiber adhesion in the sculptured areas may be minimized.

In the production of pile fabrics, it is often desirable to provide a sculptured effect on the surface thereof in order the enhance decorative appeal. One of the early attempts to achieve such sculptured effect was by means of a heated embossing roll or plate which has been engraved or otherwise treated to create a desired design in raised relief on the surface of the pile fabric. Methods which have been proposed for the elimination of the use of embossing rolls include those disclosed in U.S. Pat. Nos. 2,790,255 and 2,875,504. As disclosed in these patents, the pile fabric is formed from a combination of shrinkable and nonshrinkable yarns; and upon subjecting the fabric to the influence of heat, the pile formed from the shrinkable yarns contracts while the base and nonshrinkable yarns remain intact, thereby yielding a pile having high and low areas to provide the appearance of an embossed or carved product.

Other sculpturing methods employing shrinking of the pile fibers by chemical means are known. For instance, U.S. Pat. No. 3,830,683 to Bohrn (Armstrong Cork Co.) discloses, with regard to carpet made of acrylic material, that ethylene carbonate may be employed as a solvent or swelling agent for the fibers. The ethylene carbonate is employed as a component of the ink formulation used in the printing operation and printing may be accomplished by means of conventional printing techniques such as rotogravure, intaglio, flat, or rotary screen techniques. Printing is followed by steaming at a temperature of 200° F. to 212° F. to set the dye and to cause shrinking of the fibers in selected areas to provide an embossed effect. U.S. Pat. No. 3,797,996 to Gregorian similarly discloses a chemical process for producing a sculptured effect in three-component fabrics (face component, backing component, and water insoluble interlayer) wherein, inter alia, ethylene carbonate and propylene carbonate are disclosed as particularly suitable shrinking agents for polyacrylics (col. 4, lines 32–37).

Unfortunately, the known sculpturing methods for chemically sculpturing pile fabrics such as acrylic pile fabrics suffer certain drawbacks. Typically, for instance, when the desired level of shrinkage in the pile in the selected areas to be "sculptured" has been achieved, dissolution of the outside surfaces of the pile fibers may occur, resulting in substantial fiber-to-fiber adhesion, loss of individual fiber integrity and identity, and a consequent loss of desirable hand and even appearance characteristics of the finished product. These objectionable features of the prior art methods for chemically sculpturing pile fabrics may be avoided according to the present simple and relatively economical method.

According to the present invention, a method for sculpturing a pile fabric, e.g., acrylic pile fabric, is provided which comprises contacting selected areas to be sculptured of the pile surface of the fabric with a sufficient amount of a sculpturing composition to provide a sculptured effect, said composition comprising: at least one lower alkylene carbonate, e.g., ethylene carbonate, propylene carbonate, etc., provided in said composition in a concentration sufficient so that said fibers may be subsequently caused to shrink to a lower energy configuration upon application of heat; said sculpturing composition further containing E-caprolactam in an amount sufficient to maintain a relatively soft hand of the shrunken pile fibers; heating said pile fabric to a temperature sufficient to cause the pile height of said fibers in the selected areas of the pile fabric to be reduced sufficiently to provide a sculptured effect on said pile fabric.

The pile fabrics within the scope of the present invention include a wide range of so-called pile fabrics, e.g., pile carpets, pile upholstery fabrics and the like, although upholstery fabrics are preferred. In general the pile fabrics may be made by tufting suitable pile fibers through a suitable backing material. The pile fibers of the present invention may be made predominantly or entirely of acrylic fibers which may be prepared by techniques which are well-known in the art. Fibers are defined herein as "acrylic fibers" if they are composed of an anionic acrylic polymer, e.g., a polymer composed of at least about 60 percent, preferably about 75 percent or more, acrylonitrile groups. Where the pile fibers are less than 100 percent acrylic fibers, other fibers may be present, such as, for instance, nylon, polyester, and natural fibers, e.g., wool, but generally the amount of such other fibers will be less than about 40 percent, preferably less than about 20 percent by weight based on the total weight of the pile fibers.

The useful amount of one or more lower alkylene carbonates in the sculpturing composition may vary widely so long as the concentration of the material is sufficient so that said fibers may be subsequently caused to shrink to a lower energy configuration upon application of heat. In general, the effective concentration of the sculpturing agent, e.g. lower alkylene carbonate, on the surface of the pile fabric should be in the range of from about 20 percent to about 40 percent by weight based on the total weight of liquid in contact with the pile fibers in the selected areas. Such liquid may include the sculpturing composition as well as any applied liquids, such as the "wet out" solution, etc. If insufficient lower alkylene carbonate is employed, little or no shrinkage of the pile fibers may be achieved when the fibers are heated. If too much of the lower alkylene carbonate is employed, complete fiber dissolution may occur during the heat treatment step, resulting in an undesirable appearance and hand of the sculptured product. The useful amount of lower alkylene carbonate in the sculpturing composition may depend upon the processing conditions of the method such as, for instance, percent wet pick up of the sculpturing composition, dilution due to wicking and bleeding of the sculpturing composition, as well as dye or ink solutions, sculpturing design and heat treatment temperatures, etc. Also, for instance, if the sculpturing composition is applied to a "wet out" fabric, that is a fabric that has been previously saturated with an aqueous liquid, e.g., water, then the concentration of lower alkylene carbonate in the sculpturing composition may be somewhat higher within the prescribed range, e.g., be from about 40 percent to 80 percent by weight to provide the described effective concentration on the pile surface. If the sculpturing composition is applied to a substantially dry fabric, then the concentration of lower alkylene carbonate in the sculpturing composition may be somewhat lower within the prescribed range, e.g., from about 20 percent to about 45 percent, preferably about 30 percent to about 40 percent by weight based on the weight of the sculpturing composition to again provide the desired effective concentration on the pile surface.

As to the preferred lower alkylene carbonate, ethylene carbonate, propylene carbonate, and mixtures of ethylene and propylene carbonate may be used. It has been found in particular that mixtures of ethylene carbonate and propylene carbonate, say, mixtures containing from about 50 percent to 90 percent ethylene carbonate and from about 10 percent to 50 percent propylene carbonate, are particularly effective for use in the sculpturing composition.

In addition to the presence in the sculpturing composition of at least one lower alkylene carbonate, which is a known solvent or swelling agent for acrylic fibers, the sculpturing composition of the present invention contains E-caprolactam in an amount sufficient to maintain a soft hand of the shrunken pile fibers in the sculptured areas of the pile fabric. It has been found that the E-caprolactam functions to aid in the maintaining of a relatively soft hand in the areas to be sculptured rather than assisting in fiber shrinkage. Thus in the absence of E-caprolactam in the sculpturing composition, sculpturing compositions containing one or more lower alkylene carbonates in concentrations sufficient to achieve a desired degree of fiber shrinkage may cause dissolution of the outside surfaces of the fibers resulting in pronounced fiber-to-fiber adhesion and a consequent undesirable hand for the sculptured pile fabric product. Addition of E-caprolactam to the sculpturing composition minimizes or eliminates the fiber-to-fiber adhesion that otherwise may occur and thus aids in maintaining the integrity of the fiber and a soft hand.

The mechanism by means of which the E-caprolactam functions to achieve the above desirable results is not fully understood, and applicants' invention is not to be limited in any way by such mechanism. It is believed, however, that the E-caprolactam functions in the sculpturing composition when applied to the acrylic fibers by forming a polyamide molecular layer around the acrylic fiber to prevent complete dissolution of the outside surfaces thereof by the lower alkylene carbonate in the sculpturing composition. As with the effective amount of lower alkylene carbonate to be provided in the sculpturing composition, the concentration of E-caprolactam in the sculpturing composition should be adjusted to provide a desired concentration on the surface of the pile fibers based on total liquid in contact with the fibers. In general, however, the E-caprolactam may be present in the sculpturing composition in an amount of at least about 3 percent by weight, preferably at least about 4 percent by weight, based on the weight of the sculpturing composition.

The sculpturing composition, in addition to containing the active components, e.g., at least one lower alkylene carbonate and E-caprolactam, also contains a suitable diluent. The diluent may be a solvent for the active components, or alternatively if the active components are not soluble they should be provided in the composition in finely divided form, that is, they should be present in a micro-pulverized form with a particle diameter on the order of 100 microns or smaller, preferably even 20 microns or smaller. Such dispersion will assure that the agent becomes universally dispersed over the fibers during the process in the desired areas so that the degrading effect will be uniformly developed on the desired portions or all of the fiber. The sculpturing composition may preferably include predominant amounts of water as a diluent for the active components, although other solvents, e.g., water including minor or even predominant amounts of methanol or ethanol may be employed.

The sculpturing composition may further include a thickening agent, e.g., natural and synthetic gums and cellulose derivatives, by means of which the viscosity of the composition may be varied in a manner well known in the art in order to obtain the viscosity characteristics demanded in print technology and to enable the sculpturing composition to adhere to and operate on the fibers and to hold the printed patterns. The preferred thickening agent has been found to be Xanthan gum. In general, the viscosity of the composition may preferably be from about 100 to about 1000 cps, at 25° C., as measured by a Brookfield Viscometer Number 3 spindle at 30 revolutions-per-minute.

Other characteristics of the sculpturing composition which are desirable include compatibility with various dyes and thickeners; capability of being regulated by factors of time and temperature; and concentration, i.e., susceptibility to activation by heating, for instance, by conventional steaming operation, and exhibiting no residual sculpturing activity.

The sculpturing composition may be applied to the pile fabric which may be a dry fabric or a "wet-out" fabric, that is, a fabric that has been previously saturated with an aqueous liquid such as water. The sculpturing composition may be applied in an amount of from about 50 percent to about 500percent, preferably about 100 percent to about 300 percent by weight based upon the weight of the area of the substrate to be sculptured and the concentration of active components in the sculpturing composition.

The sculpturing composition may be applied to the pile fabric in a desired pattern in the form of a substantially transparent composition to achieve the sculptured effect and such manner of application is preferred. Alternatively, the sculpturing composition may be part of a dye or pigment composition used in printing the fabric so that the color appears in perfect register where the sculpturing composition has been selectively applied. The dye or pigment may generally be in the form of a printing paste ink to which the appropriate amount of agent is added. In preparing such modified dye compositions, viscosities and dye concentration which are essential to an efficient dyeing operation must also be controlled. The resultant effect is a sculptured design in register with the printed pattern with color in the printed areas.

As mentioned above, in a preferred embodiment, the sculpturing composition may be applied to the fabric substrate before, during, or even after application of, but prior to heat setting of, the various dyes to the fabric which may be applied in a pattern. The sculpturing composition may be applied in register with the dye pattern and when so applied, the dyes on the fabric in areas adjacent to the areas to be sculptured may desirably "bleed into" or migrate into the areas to be sculptured, providing a desirable aesthetic effect in the product fabrics. Such migration may in fact be promoted by appropriate adjustment of the rheology characteristics of the sculpturing composition and dye composition. According to this preferred embodiment, after application of the sculpturing composition, the fabric may be heat-treated, e.g., with steam to set the dyes and to case shrinking of the fibers in the sculptured areas of the fabric.

With regard to the selected areas where the sculpturing composition has been applied, the extent of shrinkage and hence the depth of sculpturing may be controlled by varying the amount of sculpturing composition applied or by varying the concentration of lower alkylene carbonate in the sculpturing composition, or both. Furthermore, the amount of pile height reduction in the selected areas can also be controlled to a certain extent by the depth of penetration of the composition containing the sculpturing agent into the pile of the fabric. Penetration can be controlled by varying, for instance, the viscosity of the sculpturing composition.

Application of the sculpturing composition to the pile fabric may be accomplished by utilizing one of the many types of known printing apparatus, thereby eliminating the need for expensive embossing or sculpturing equipment. Furthermore, it allows the sculpturing of a surface without exerting such pressure on the pile to result in permanent deformation of the fabric pile. In addition, although the sculpturing does result from shrinkage of the pile in selected areas, the product typically has a much softer hand than would otherwise be provided for a given depth of sculpturing due to the presence in the sculpturing composition of the unique combination of active components; and, also, the product exhibits all or more of the advantages of products made by range printing techniques as opposed to woven fabric or hand-sculptured fabric. The preferred apparatus for application of the sculpturing composition is depicted in the attached drawing which is fully described hereinbelow.

After the sculpturing composition has been applied to the pile fabric, the fabric may be heated to a temperature sufficient to cause a substantial reduction of pile height of the fibers. The heating step may also serve to fix any dye that may have been applied to the textile material. Generally, temperatures of from about 120° F. to about 250° F. may be employed. Steam may be conveniently used for this purpose, and if it is desired to employ elevated temperatures above 212° F. in steaming, super-heated steam or pressurized steam may be used. The temperature to which the fabric is heated may vary significantly, depending upon concentration of active components in the sculpturing.

Generally, the pile fabric may be subjected to heating for a time sufficient to cause shrinkage of the selected portions of the pile fabric. Heating may simultaneously serve to fix the dyes which have been applied. Where the heating means is steam, it has been found that heating should be for at least about one minute, preferably about three to about 30 minutes. The time of heating and the temperature of the atmosphere should be adjusted to result in the desired degree of shrinkage for the particular fiber substrate. Thus, if the temperature is too low or if the time of treatment is too short, insufficient shrinkage will occur to provide an aesthetically pleasing product. If the temperature is too high, the pile may completely dissolve, which will result in an undesirable product having an unpleasant hand in the sculptured areas.

After heating, the pile fabric may be washed, preferably with water, to remove any residual components of the sculpturing composition from the pile fabric and also to remove any unfixed dye and thickening agent that may be present. After washing, the fabric may be dried by conventional means.

A large number of products can be produced by the process of the present invention. The products can be used for floor, wall, and ceiling coverings, drapery, upholstery, and the like. In fact, the products may be used wherever conventional pile fabrics are utilized. They are readily adaptable to decorating any surface on which pile fabrics can be applied. Many additional applications will occur to those skilled in the art.

As mentioned above, especially desirable results can be obtained where the sculpturing composition is applied to the textile material by means of a jet dyeing process and apparatus such as disclosed in U.S. Pat. Nos. 4,084,615; 4,034,584; 3,985,006; 4,059,880; 3,937,045; 3,894,413; 3,942,342; 3,939,675; 3,892,109; 3,942,343; 4,033,154; 3,969,779; 4,019,352; pending U.S. Patent Application U.S. Ser. No. 686,900, filed May 17, 1976, now U.S. Pat. No. 4,116,626, entitled "Printing of Pattern Designs with Computer Controlled Pattern Dyeing Device"; and U.S. Patent Application U.S. Ser. No. 806,783, filed June 15, 1977, now U.S. Pat. No. 4,095,444, entitled "Apparatus for the Application of the Liquids to Moving Materials," each of said patents and patent applications being hereby expressly incorporated by reference.

In a jet dyeing process and apparatus such as set forth in U.S. Pat. No. 3,969,779, a jet pattern dyeing machine is provided with a plurality of gun bars, each containing plural dye jets extending across the width of an endless conveyor. The gun bars are spaced along the conveyor, and the textile material to be sculptured is carried by the conveyor past the gun bars, where any desired dyes and the sculpturing composition are applied to form a pattern thereon. The application of the dyes and the sculpturing composition from the individual dye jets in the gun bars is controlled by suitable adapted pattern control means such as mentioned in U.S. Pat. Nos. 3,969,779 and 4,033,154. The textile material to which any desired dyes and the sculpturing composition have been applied in a pattern is then passed through a steamer wherein the textile material is subjected to a steam atmosphere to fix any dyes thereon and to cause shrinkage of the pile fibers in the areas to be sculptured. The sculptured textile material leaving the steam chamber is conveyed through a water washer to remove excess sculpturing agent and any unfixed dye therefrom. The washed textile material is then passed through a hot air dryer to a delivery and take-up means.

While the application of the sculpturing composition to the textile material has been set forth by a jet printing apparatus, it is to be understood that any suitable means for applying such sculpturing composition and dye, if desired, in the form of a pattern to a textile substrate may be employed. For example, the sculpturing composition can be applied to the textile material employing transfer printing technique, e.g., a dry printing technique.

In order to more fully depict the sculpturing process in accordance with the invention, reference will now be made to the drawing, where a jet injection dyeing apparatus is depicted to sculpture the textile material. Supply roll 107 of the FIGURE is mounted on a suitable support 109. The textile material is advanced through apparatus 110 as follows. The textile material is advanced onto the lower end of inclined conveyor 111 of jet applicator section 112, where the sculpturing composition and any desired dyes are applied to the textile material by a programmed operation of a plurality of jet gun bars, generally indicated at 113, which inject streams of sculpturing composition and any desired dyes onto the face surface of the textile material during its passage thereunder. The textile material to which the sculpturing composition has been applied leaving the applicator section is moved by conveyors 114 and 116, driven by motors 117 and 118 to a steam chamber 119, where the textile material is subjected to a steam atmosphere to cause shrinking of the areas of the textile material to be sculptured and to fix any dyes which may be present thereon. The sculptured textile material leaving steam chamber 119 is conveyed through a water washer 121 to remove excess sculpturing composition and any dye from the textile material. Thereafter, the washed textile material is passed through a hot air dryer 122 to take-up roll 123, which is mounted on a suitable support 124.

The above sequence of steps and processes set forth schematically illustrate the most desired method for producing the improved products in accordance with the subject invention. In order to more fully illustrate the concept of the subject invention, the following examples are given, wherein all parts and percentages are by weight unless otherwise indicated. It is to be understood, however, that such examples are not to be construed as unduly limiting the scope of the invention as set forth in the appended claims.

EXAMPLE 1

A sculpturing composition was prepared containing 40 percent by weight Catalyst 3, which is a blend of ethylene carbonate and propylene carbonate available from Chemical Processing of Georgia, 6 percent by weight E-caprolactam, and 0.5 percent by weight Xanthan gum. The remainder of the composition was water present as a diluent. The sculpturing composition was applied to an acrylic fabric (Monsanto's Acrilan type B16, 12 denier singles yarn) which was in the form of a tufted velvet upholstery fabric with a 1/25-inch tufting gauge, 24 stitches to the inch, 3/32-inch pile height, and a face weight of 0.8687 pounds per linear yard at a width of 54 inches.

The fiber shrinking composition was applied to preselected areas of the dry fabric at approximately 150 percent wet pickup based on the weight of the selected areas of the fabric by means of the apparatus illustrated in the FIGURE. The preselected areas were in register and adjacent to other preselected areas to which a dye liquor containing the following was applied, also by means of the apparatus shown in the FIGURE: 0.50 percent by weight Xanthan gum, 0.50 percent by weight Levalin VKU which is a blend of anionic and nonionic surfactants available from Mobay Chemical Company, 2.0 percent by weight Dowanol EPh which is phenyl cellosolve (a dye solvent and fiber swelling agent) available from Dow Chemical Corporation, 5.0 percent by weight acetic acid (86%), and 0.0 percent to 0.50 percent by weight cationic dyestuff.

The fabric was then steamed at 212° F. for ten minutes to activate the reaction between the fiber and the shrinking composition and to fix the dye. It was then washed with water to remove any chemicals and thickening agents present on the fabric. The fabric was then dried and finished according to standard techniques used for textile printing.

During and after the process, the following observations were made:

(1) There was no reduction in pile height in the sculptured areas prior to steaming.

(2) Before and during the steaming operation, dyes from adjacent areas migrated into areas to be sculptured, resulting in the imparting of desired coloration in the sculptured areas.

(3) After steaming, 50–70 percent pile height reduction is evident with little loss in individual fiber integrity.

(4) Photomicrographs indicate little fiber-to-fiber adhesion in shrunken areas.

(5) Standard textile testing results showed no change in the properties, i.e., lightfastness, crock, tensile strength, or cleanability over untreated fabric.

EXAMPLE 2

Example 1 was repeated except that the concentration of Catalyst 3 in the sculpturing composition was increased from 40 to 50 percent. Shrinkage and loss of fiber identity before steaming were observed, and a molten polymer residue was formed during steaming which, when cooled, became hard and crust-like.

EXAMPLE 3

Example 1 was repeated except that the concentration of Catalyst 3 in the sculpturing composition was decreased from 40 perecent to 30 percent. After steaming, only 5 to 10 percent pile height reduction was observed.

EXAMPLE 4

Example 1 was repeated except that the concentration of E-caprolactam in the sculpturing composition was increased from 6 percent to 7 percent. The resultant fabric was the same as in Example 1.

EXAMPLE 5

Example 1 was repeated except that the concentration of E-caprolactam in the sculpturing composition was decreased from 6 percent to 3 percent. After steaming, 50–70 percent pile height reduction was observed, but the shrunken areas had a harsh hand and photomicrographs show evidence of substantial fiber-to-fiber adhesion.

EXAMPLE 6

Example 1 was repeated except that the sculpturing composition also contained 0.2 percent by weight cationic dyestuff. The sculpturing mix was observed as a single phase dye and sculpturing system where standard dye systems are two-liquid phases. The dye in the sculpturing composition fixed in the sculptured areas, resulting in a sculptured area with a different color than the adjacent areas. No change in the above-mentioned textile testing results was observed.

EXAMPLE 7

Example 1 was repeated except that the fabric was pre-dyed and finished and no other colors were applied. Seventy-to-eighty percent pile height reduction was observed and the sculptured areas were very sharp and had a high degree of resolution.

EXAMPLE 8

Example 1 was repeated except that the fabric was wet-out prior to application of the sculpturing composition with 80 percent based on the weight of the fabric of a thickened aqueous solution having a viscosity of 500 centipoises (Brookfield spindle #3 at 30 rpm). The sculpturing composition was changed from 40 percent to 70 percent by weight Catalyst 3 and from 6 percent to 10.5 percent by weight E-caprolactam. The resulting product was very similar to that of Example 1 except it was observed that the dyed areas were somewhat more uniformly colored.

What is claimed is:

1. In a process for sculpturing a pile fabric comprising at least about 80 percent by weight acrylic pile fibers with a jet dyeing apparatus including conveying means for transporting the textile, jet orifices for delivering a sculpturing composition to selected area of said pile fabric, said sculpturing composition containing at least one lower alkylene carbonate in a concentration sufficient to partially solvate the fibers of the pile in the selected areas, and control means for supplying data to control the operation of the application of the sculpturing composition by means of the jet dyeing apparatus by applying an aqueous admixture to the pile fabric in an amount sufficient to saturate the pile fabric, applying the sculpturing composition to the areas of the textile fabric to be provided with a sculptured effect, and recovering a resulting sculptured textile fabric, the improvement comprising incorporating E-caprolactam into the sculpturing composition in an amount of at least about 3 weight percent.

2. The product produced by the process of claim 1.

3. The process as defined in claim 1 wherein said sculpturing composition contains from about 40 percent to about 80 percent by weight of a lower alkylene carbonate selected from ethylene carbonate, propylene carbonate, and mixtures of ethylene carbonate and propylene carbonate.

4. The process of claim 3 wherein the mixture of ethylene carbonate and propylene carbonate comprises from about 50 percent to about 90 percent by weight ethylene carbonate and from about 10 percent to about 50 percent by weight propylene carbonate.

5. In a process for sculpturing a pile fabric comprising at least about 80 percent by weight acrylic pile fibers which includes the steps of applying a sculpturing composition to selected areas of the pile fabric to be sculptured, said sculpturing composition containing at least one lower alkylene carbonate in an amount sufficient to cause said fibers to shrink to a lower energy configuration upon application of heat, heating the textile material to which the sculpturing composition has been applied at a temperature effective to result in shrinking of the pile fibers to which said sculpturing composition has been applied; the improvement comprising incorporating E-caprolactam into the sculpturing composition in an amount sufficient to maintain a relatively soft hand of the shrunken pile fibers.

6. The product produced by the process of claim 5.

7. The process as defined in claim 5, wherein said textile fabric is modified prior to application of the sculpturing composition by applying water to the textile fabric in an amount sufficient to saturate the textile fabric.

8. A method for sculpturing a pile fabric wherein the pile fibers comprise at least 80 percent by weight acrylic fibers which comprise selectively contacting the pile surface of the pile fabric with a sculpturing composition, said composition containing at least one lower alkylene carbonate in a concentration sufficient so that said fibers may be subsequently caused to shrink to a lower energy configuration upon application of heat; said sculpturing composition further containing E-caprolactam in an amount sufficient to maintain a soft hand of the shrunken pile fibers; and heating said pile fabric in the selected areas of the pile fabric to be reduced sufficiently to provide a sculptured effect on said pile fabric.

9. The product produced by the method of claim 8.

10. The method of claim 8, wherein said lower alkylene carbonate is selected from ethylene carbonate, propylene carbonate, and mixtures of ethylene and propylene carbonate.

11. The method of claim 8, Wherein said heating is caused by the application of steam for at least about one minute.

12. The method of claim 11, wherein said pile fabric is washed after heating and then dried to provide a dried, sculptured pile fabric.

13. A method for sculpturing an acrylic pile upholstery fabric which comprises selectively contacting the pile surface of the fabric with a sculpturing composition, said composition comprising at least one lower alkylene carbonate selected from ethylene carbonate, propylene carbonate, and mixtures of ethylene and propylene carbonate in an amount sufficient to cause said fibers to shrink to a lower energy configuration upon application of heat; said sculpturing further containing at least about 3 percent E-caprolactam; heating said pile fabric by the application of steam thereto to cause the pile height of said fibers in the selected areas of the pile fabric to be reduced; washing said pile fabric to remove any residual sculpturing composition present therein; and drying said pile fabric to provide a dried pile fabric product.

14. The method of claim 13, wherein said sculpturing composition is applied to said pile fabric as a component of a dye or pigment composition used in printing the fabrics so that a color appears in register with the areas where said sculpturing composition has been selectively applied.

15. The method of claim 13, wherein said sculpturing composition is applied to said pile fabric as a separate component from any dye composition applied thereto and said sculpturing composition is applied subsequent to the application of said dye composition, wherein said dye composition is applied in a pattern and said sculpturing composition is applied in register with said pattern, whereby dye from said areas where the dye has been applied is caused to migrate into the areas where said sculpturing composition has been applied, thereby providing coloration to said sculptured areas.

* * * * *

UNITED STATES PATENT OFFICE

CERTIFICATE OF CORRECTION

Patent No. 4,290,766 Dated September 22, 1981

Inventor(s) Alonzo M. Burns, Jr., et al.

It is certified that error appears in the above-identified patent and that said Letters Patent are hereby corrected as shown below:

Column 1, line 46, the words "inter alia" should be --inter alia--.

Column 2, line 64, the word "scribed" should be --sired--.

Column 4, line 68, the word "case" should be --cause--.

Signed and Sealed this

Ninth Day of February 1982

[SEAL]

Attest:

GERALD J. MOSSINGHOFF

Attesting Officer

Commissioner of Patents and Trademarks